United States Patent [19]

Nomura et al.

[11] Patent Number: 4,781,553

[45] Date of Patent: Nov. 1, 1988

[54] SCREW VACUUM PUMP WITH LUBRICATED BEARINGS AND A PLURALITY OF SHAFT SEALING MEANS

[75] Inventors: Ituro Nomura, Takarazuka; Kunihiko Nishitani, Akashi; Noboru Tsuboi, Kakogawa, all of Japan

[73] Assignee: Kabushiki Kaisha Kobe Seiko Sho, Kobe, Japan

[21] Appl. No.: 77,219

[22] Filed: Jul. 24, 1987

[51] Int. Cl.[4] ..... F04C 18/16; F04C 27/00; F04C 29/02; F16J 15/16

[52] U.S. Cl. ..... 418/104; 418/201; 277/3; 277/71; 277/72 R; 277/79

[58] Field of Search ..... 418/104, 201, 202, 203; 277/3, 70–72, 79

[56] References Cited

U.S. PATENT DOCUMENTS 4,153,395 5/1979 O'Neill ..... 418/104
4,329,126 5/1982 Nishimura ..... 418/104
4,487,563 12/1984 Mori et al. ..... 418/104

FOREIGN PATENT DOCUMENTS 54-37693 11/1979 Japan .
57-59920 12/1982 Japan .
59-185889 10/1984 Japan .

*Primary Examiner*—John J. Vrablik
*Attorney, Agent, or Firm*—Oblon, Fisher, Spivak, McClelland, & Maier

[57] ABSTRACT

A screw vacuum pump which includes a casing having a rotor chamber opened at its one end to a suction opening and opened at the other end to a discharge opening; a pair of male and female screw rotors rotatably received in the rotor chamber, each of the screw rotors having a pair of rotor shafts supported by forcibly lubricated bearings on both sides of the suction opening and the discharge opening; at least one first sealing member provided between the bearing on at least the suction opening side and the rotor chamber and communicated with a space under pressure less than atmospheric pressure which space is out of communication with the suction opening; and at least one second sealing member provided between the bearing on at least the suction opening side and the rotor chamber and communicated with the atmosphere, the first and second sealing members being arranged in this order from the rotor chamber side.

2 Claims, 8 Drawing Sheets

SCREW VACUUM PUMP WITH LUBRICATED BEARINGS AND A PLURALITY OF SHAFT SEALING MEANS

BACKGROUND OF THE INVENTION

1. Field of the Invention

The present invention relates to a screw vacuum pump, and more particularly to a screw vacuum pump suitable for an oil free type using a screw pump body having a pair of male and female screw rotors meshed with each other.

2. Description of the Prior Art

As a known vacuum pump, there exists a water sealed vacuum pump (Japanese Patent Publication No. 54-37693), a high vacuum pump (Japanese Patent Publication No. 57-59920), and a dual shaft type vacuum pump (Japanese Patent Laid-open No. 59-185889), for example.

In the water sealed vacuum pump and the high vacuum pump, gas is led from a suction opening to a discharge opening under the condition where it directly contacts with water or oil during obtaining vacuum, so as to prevent an increase in temperature of the gas due to heat generated upon compression of the gas in the pump. Thus, the device as well as the gas is cooled.

However, in this kind of vacuum pump, there is a possibility that the odor of the water or oil leaks to the suction opening. Further, in the event that the device is suddenly stopped because of a power failure, for example, the water or oil will flow reversely to the suction opening. Therefore, such a vacuum pump cannot be used in the semiconductor manufacturing industry which never permits mixing of impurities and the food industry (e.g., vacuum packaging) which particularly refuses the generation of odor.

On the other hand, the dual shaft type vacuum pump includes an oil free type such as a Root's type mechanical booster (The oil free type vacuum pump in the present invention is of a type such that the gas to be vacuumized is not in contact with the water and oil).

However, in this type of vacuum pump, a large amount of gas between the rotors is necessarily defined because both the rotors are required to be maintained without contact with each other. Accordingly, although this vacuum pump is employable in a medium vacuum range ($10^{-3}$–1 Torr), it is not suitable for use in a low vacuum range (1–760 Torr) because the leakage of gas from between the rotors increases to remarkably raise the gas temperature.

Thus, a single stage oil free type vacuum pump suitable for use over a low vacuum range to a high vacuum range has not previously been known, and it is therefore desired to develop such a vacuum pump.

SUMMARY OF THE INVENTION

The present inventor has found that an oil free type screw compressor conventionally used for primarily generating a high pressure gas under pressure higher than the atmospheric pressure has a function common to that of a vacuum pump in that the gas is sucked and discharged under a compressed condition. Furthermore, he has also found that the screw compressor has the capability of reducing the leakage of gas from between the rotors. Then, he has conducted various trials for the usage of the vacuum pump.

As the result, the following problem has become apparent. That is, a bearing portion and a shaft seal portion of screw rotors in the screw compressor are maintained under atmospheric pressure or nearly under atmospheric pressure. Accordingly, when the screw compressor itself is used for a vacuum pump, the air leaks from the shaft seal portion to the rotor chamber especially on the suction opening side, thus causing a reduction in attainable vacuum.

The attainable vacuum is a maximum degree of vacuum attainable when the vacuum pump is operated under the condition where a flange of the suction opening is completely closed, which is the most important point of performance in the vacuum pump.

SUMMARY OF THE INVENTION

It is an object of the present invention to provide a screw vacuum pump which may hinder the leakage of oil from a bearing to a rotor chamber by an atmospheric communication passage and prevent contamination in the rotor chamber.

It is another object of the present invention to provide a screw vacuum pump which may reduce the leakage of air to a suction opening and thereby improve an attainable vacuum.

It is a further object of the present invention to provide a screw vacuum pump which may obtain a wide vacuum range with use of a single stage oil free compressor.

According to the present invention, there is provided a screw vacuum pump comprising a casing having a rotor chamber opened at its one end to a suction opening and opened at the other end to a discharge opening; a pair of male and female screw rotors rotatably received in the rotor chamber, each of the screw rotors having a pair of rotor shafts supported by forcibly lubricated bearings on both sides of the suction opening and the discharge opening; at least one first sealing means provided between the bearing on at least the suction opening side and the rotor chamber and communicated with a space under pressure less than the atmospheric pressure which space is out of communication with the suction opening; and at least one second sealing means provided between the bearing on at least the suction opening side and the rotor chamber and communicate with the atmosphere, the first and second sealing means being arranged in this order from the rotor chamber side.

Other objects and features of the invention will be more fully understood from the following detailed description and appended claims when taken with the accompanying drawings.

DESCRIPTION OF THE PREFERRED EMBODIMENTS

Figure 1:
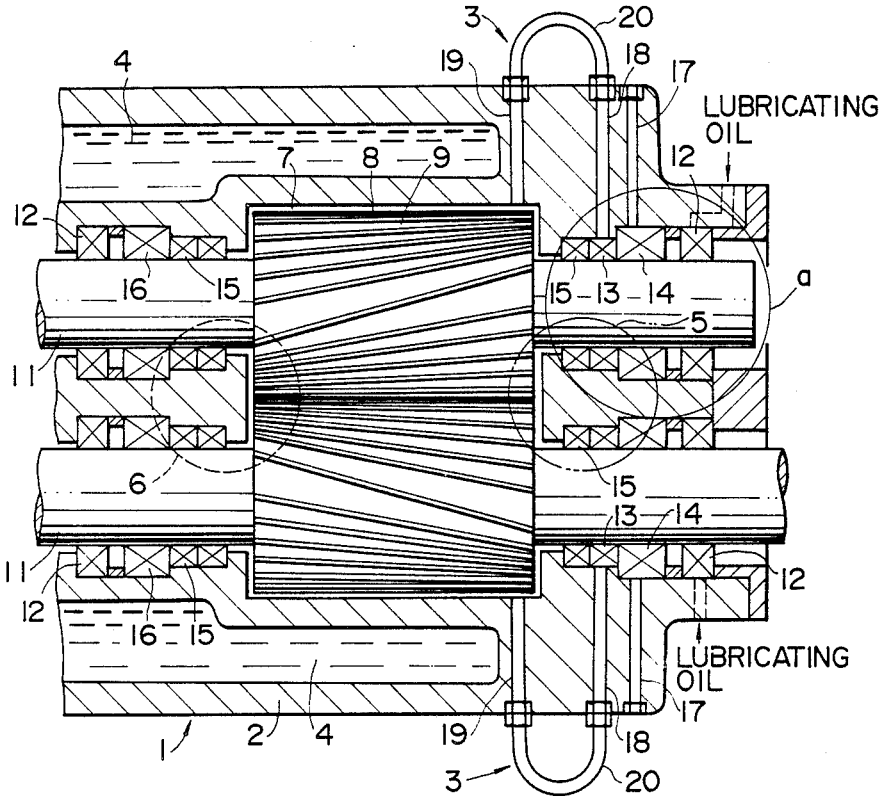
FIG. 1 is a transverse sectional view of the screw vacuum pump of a first preferred embodiment according to the present invention.
Figure 2:
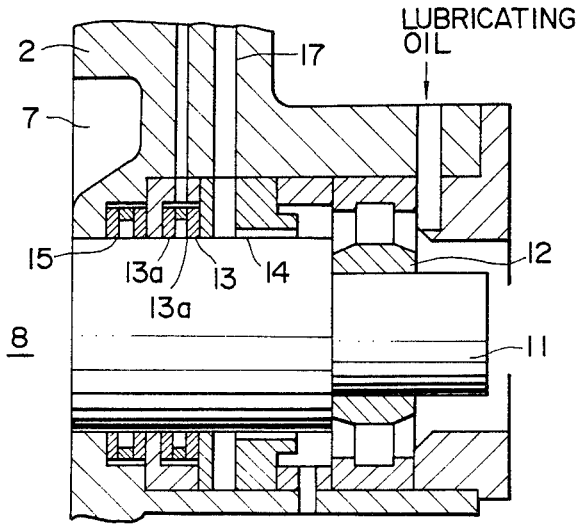
FIG. 2 is an enlarged view of an encircled part a shown in FIG. 1.

Referring now to FIGS. 1 and 2 which show a first preferred embodiment of the present invention, reference numeral 1 generally designates an oil free type pump body having a casing 2. The casing 2 includes a water cooling jacket 4, a rotor chamber 7 openable at one axial end thereof to an upper suction opening 5 (encircled by alternate long and two short dashed lines) and also openable at the other axial end to a lower discharge opening 6 (encircled by a broken line), and a pair of male and female screw rotors 8 meshing with each other which are rotatably received in the rotor chamber 7. Each of the screw rotors 8 has a tooth space portion 9 adapted to change its position by the rotation of the screw rotors 8, thereby sequentially repeating the three conditions, that is, a first condition where the tooth space portion 9 opens to the suction opening 5 (gas suction condition), a second condition where the tooth space portion 9 is isolated from both the suction opening 5 and the discharge opening 6 (gas confined condition), and a third condition where the tooth space portion 9 opens to the discharge opening 6 (gas discharge condition). Thus, the tooth space portion 9 functions to define a gas suction space, a gas compression (confined) space and a gas discharge space corresponding to the gas suction condition, the gas confined condition and the gas discharge condition, respectively.

Each of the screw rotors 8 has rotor shafts 11 supported by forcibly lubricated bearings 12. There are provided a first sealing means 13 and a second sealing means 14 between the bearings 12 on the suction side and the rotor chamber 7. The first sealing means 13 and the second sealing means 14 are arranged adjacent one another in this order from the rotor chamber 7 side. Preferably, the first sealing means 13 is constituted of two seal rings 13*a* which are juxtaposed, and the second sealing means 14 employs a labyrinth seal formed with a thread adapted to advance toward the bearing 12 in association with rotation of the screw rotor 8.

A communication pipe 3 is provided to communicate a shaft seal portion of the first sealing means 13 with the tooth space portion 9 of the rotor functioning as a gas confined space not communicated with the suction opening 5 in the rotor chamber 7.

The communication pipe 3 is constituted of a first through-hole 18 for communicating the seal ring of the first sealing means 13 to the exterior of the casing 2, a second through-hole 19 for communicating the tooth space portion 9 just after the gas confined condition to the outside of the casing 2, and a connection pipe 20 for communicating the first and second through-holes 18 and 19. With this arrangement, the pressure at the shaft seal portion of the first sealing means may be maintained as low as possible by applying a vacuum to the tooth space portion just after the gas confined condition as isolated from the suction opening 5.

There is further provided in the casing 2 an atmospheric communication pressure 17 for communicating the shaft seal portion of the second sealing means 14 to atmosphere.

According to the preferred embodiment, a pressure differential between the suction opening 5 and the first sealing means 13 may be reduced to thereby prevent air leakage from the first sealing means 13 to the suction opening 5.

Conventionally, there has been a possibility that the lubricating oil cannot be sufficiently expelled from the labyrinth portion of the second sealing means 14 during rotation other than high speed rotation of the screw rotors 8. To cope with this problem, the present invention provides the atmospheric communication passage 17 communicated with the second sealing means 14 to expel the lubricating oil advancing from the bearing 12 to the rotor chamber 7 through the atmospheric communication passage 17 to the outside of the casing. Therefore, the lubricating oil may be prevented from flowing into the rotor chamber 7 even during rotation other than high speed rotation of the screw rotors 8. Furthermore, even in the event that the lubricating oil leaks from the labyrinth portion, it is discharged through the gas confined space isolated from the suction opening 5 owing to the provision of the communication pipe 3, and such is therefore completely prevented from leaking to the suction opening 5. The above-mentioned function of the communication pipe 3 utilizes a unique characteristic of the screw pump such that the three independent spaces consisting of the gas suction space, the gas confined space and the gas discharge space are normally defined.

Preferably, a third sealing means 15 having two seal rings similar to the seal rings 13a is arranged adjacent the first sealing means 13 on the rotor chamber 7 side. Further, there are provided, between the bearing 12 on the discharge side and the rotor chamber 7, two stages of the third sealing means 15 and a fourth sealing means 16 having a labyrinth seal similar to that of the second sealing means 14 as arranged in this order from the rotor chamber 7 side. In this case, the lubricating oil is forced by each labyrinth portion of the second and fourth sealing means 14 and 16 to the bearings 12 side by the rotation of the screw rotors 8. Accordingly, the lubricating oil is more reliably prevented from flowing into the rotor chamber 7.

It should be noted that the third and fourth sealing means 15 and 16 are not essential in the present invention.

Figure 3:
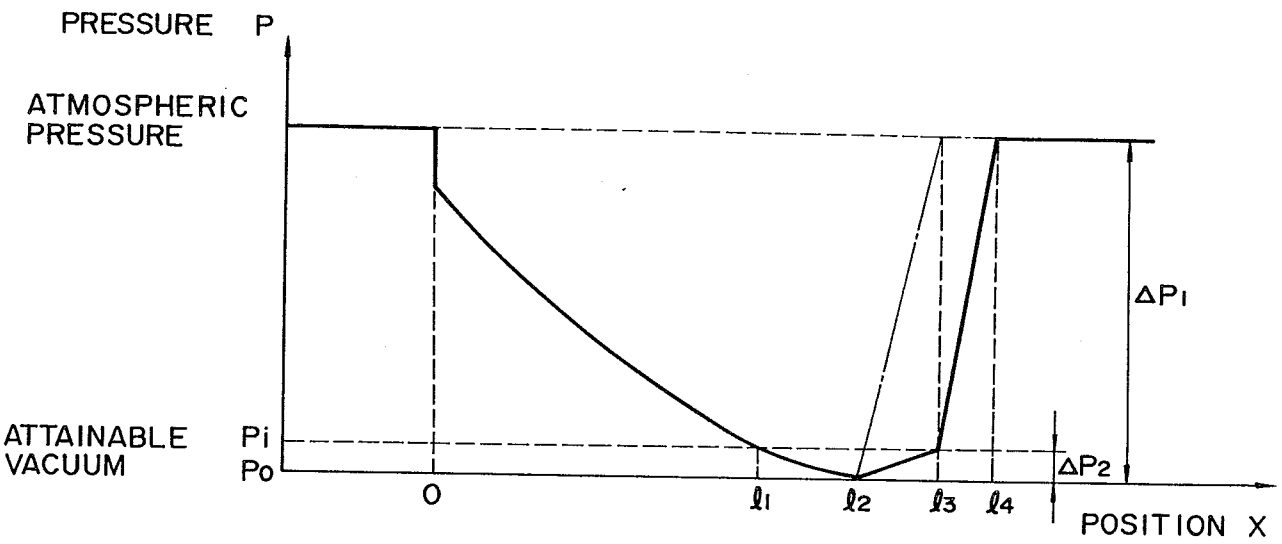
FIG. 3 is a graph showing a change in pressure at various positions in the axial direction along the rotor shaft in the vacuum pump shown in FIG. 1.

FIG. 3 shows a change in pressure at various positions along the axial direction of the rotor shaft 11 from the bearing 12 on the suction side through the suction opening 5 and the interior of the rotor chamber 7 to the discharge opening 6. Referring to FIG. 3, the abscissa shows the positions x along the axial direction of the rotor shaft (a rightward direction is regarded as positive) with the origin corresponding to the end surface of the discharge opening 6 of the rotor chamber 7, and the ordinate showing a degree of vacuum or pressure, where $l_1$ denotes the position of the second through-hole 19; $l_2$ denotes the position of the end surface of the suction opening 5 of the rotor chamber 7; $l_3$ denotes the position of the first through-hole 18; $l_4$ denotes the position of the atmosphere communication passage 17; and $P_i$ denotes the pressure at the second through-hole 19.

An alternate long and short dash line as shown in FIG. 3 shows a pressure condition provided that only the first through-hole 18 is substituted for the communication pipe 3. Under the pressure condition, the pressure at the seal rings 13*a* of the first sealing means 13 is made substantially equal to atmospheric pressure so that the lubricating oil may be prevented from leaking to the rotor chamber which nevertheless leaks from the labyrinth portion, thus double preventing the leakage of the lubricating oil in combination with the atmosphere communication passage 17.

Comparing the alternate long and short dash line with a solid line in FIG. 3, a pressure differential between pressure at $x=l_3$ of the first sealing means 13 and pressure or attainable vacuum $P_o$ at $x=l_2$ of the suction opening 5, which pressure differential should be considered in preventing the leakage of air to the rotor chamber, may be expressed in the following manner as to the dash line.

$$\Delta P_1 = (\text{atmospheric pressure}) - (\text{attainable vacuum } P_o)$$

On the other hand, the pressure differential as to the solid line may be expressed as follows:

$$\Delta P_2 = P_i - (\text{attainable vacuum } P_o)$$

where, since $P_i$ is naturally smaller than the atmospheric pressure ($P_i$<atmospheric pressure), the inequality $\Delta P_2 < \Delta P_1$ should hold necessarily.

Accordingly, the leakage of air from the first sealing means 13 to the rotor chamber 7 is reduced corresponding to a decrement of the pressure differential.

Although the communication pipe 3 is communicated with the tooth space portion of the rotor chamber 7 just after the gas confined condition in the preferred embodiment, it should be appreciated that the present invention is not limited to such a construction as noted above. That is, the shaft seal portion of the first sealing means 13 should be vacuumized to pressure lower than atmospheric pressure. For instance, the first through-hole 18 may be connected through a piping to another vacuum pump to vacuumize the shaft seal portion by operating the additional vacuum pump.

Figure 4:
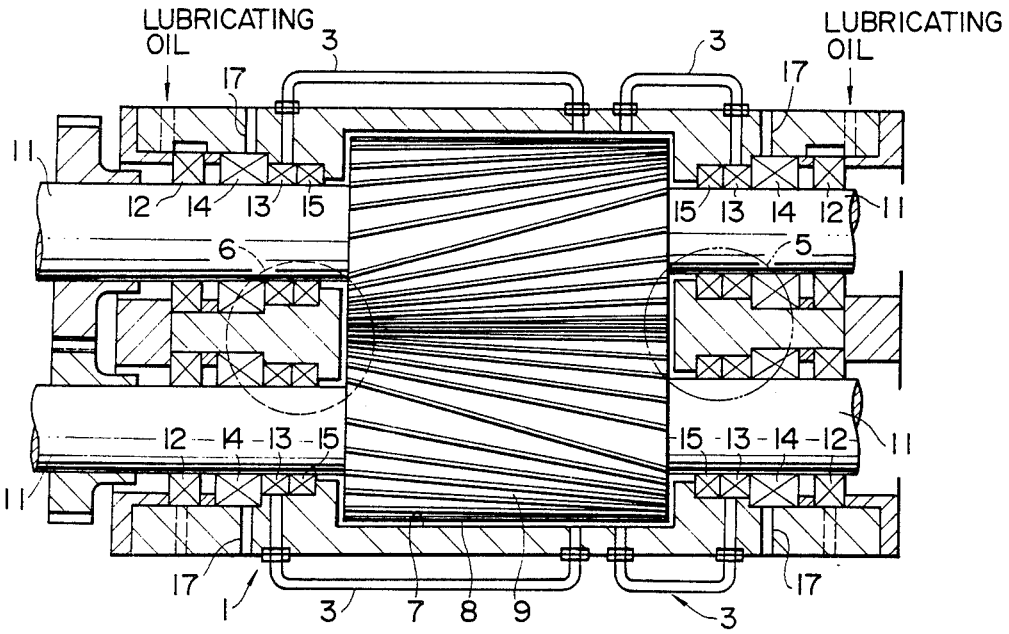
FIG. 4 is a transverse sectional view of the screw vacuum pump of a second preferred embodiment according to the present invention.

Referring next to FIG. 4 which shows a second preferred embodiment, the first and second sealing means 13 and 14, the communication pipes 3 and the atmospheric communication passages 17 are provided on both the suction and discharge sides. The end surface of the discharge opening 6 of the rotor chamber 7 is continuously exposed to both the gas discharge space and the end surface of the tooth space portion just after changing from the gas discharge condition to the gas suction condition. The gas suction space of the tooth space portion is naturally in a vacuum condition, and accordingly a gap formed between the rotor chamber 7 and the screw rotors 8 is in a vacuum condition. As a result, similar to the suction opening 5 side, the lubricating oil and the air on the discharge opening 6 side tend to leak from the shaft seal portion through the gap and the tooth space portion as the suction space to the suction opening 5. According to the second embodiment, the first and second sealing means 13 and 14 on the discharge opening 6 side function to prevent the leakage of oil and air as mentioned above and effectively contribute to the improvement in attainable vacuum.

Figure 5:
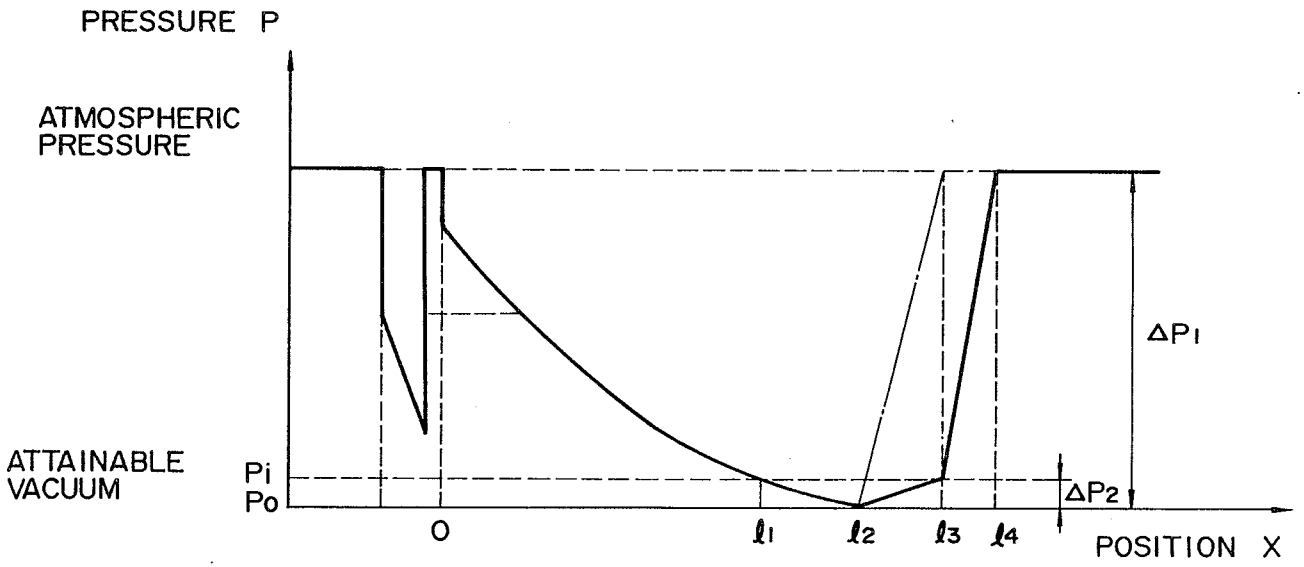
FIG. 5 is a graph showing a change in pressure in the vacuum pump shown in FIG. 4.

In the second embodiment shown in FIG. 4, parts common to those in FIG. 1 are designated by the same reference numerals (similarly in subsequent embodiments to be described). FIG. 5 shows a pressure condition in the screw vacuum pump shown in FIG. 4, which corresponds to the graph shown in FIG. 3.

Figure 6:
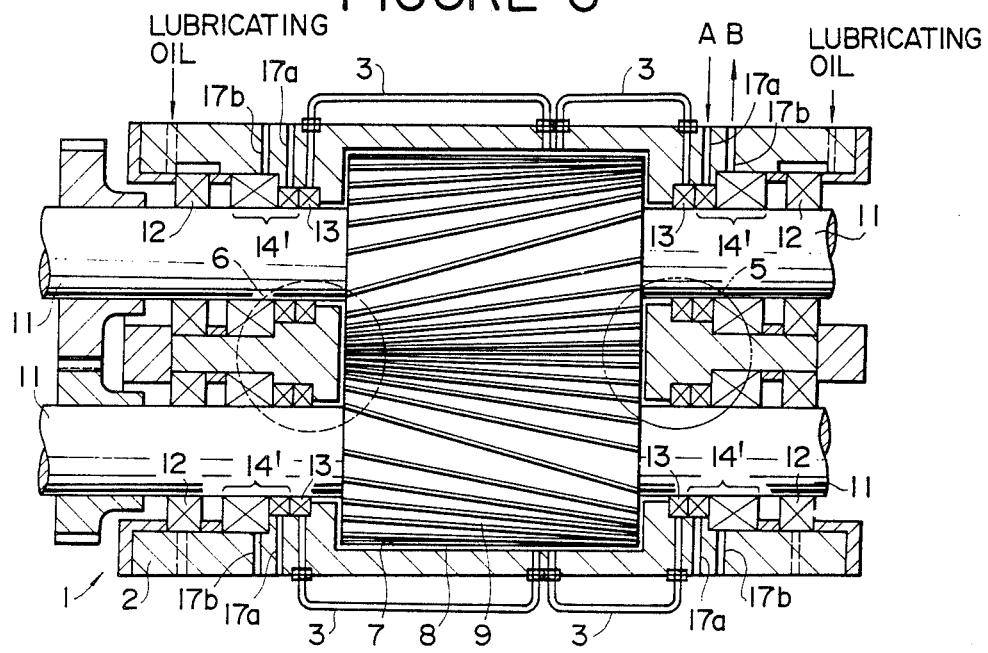
FIG. 6 is a transverse sectional view of the vacuum pump of a third preferred embodiment according to the present invention.

Referring to FIG. 6 which shows a third preferred embodiment, two stages of second sealing means 14 are provided. In the embodiment shown in FIG. 6, the lubricating oil tending to advance from the bearings 12 to the rotor chamber 7 may be expelled through atmospheric communication passages 17*b* on the bearings 12 side to the outside of the casing by the air flow depicted by arrows A and B more effectively than the case including one stage of the second sealing means.

The two stages of the second sealing means 14' may be provided on only the suction opening 5 side. Furthermore, although the first and second sealing means 13 and 14' are arranged symmetrically with respect to both the male and female rotors in this embodiment, the present invention is not limited to such an arrangement as described above. For instance, such may be mounted on the rotor shafts of either the male or female rotor.

In the case where the rotor chamber is required to be cooled in the previous embodiment shown in FIGS. 4 and 6, the casing 2 may be suitably designed to have a water cooling jacket.

FIGS. 7 to 11 show further modified embodiments of the present invention providing a plurality of stages of the first sealing means 13 for the purpose of more effectively reducing the leakage of gas to the suction opening 5.

Figure 7:
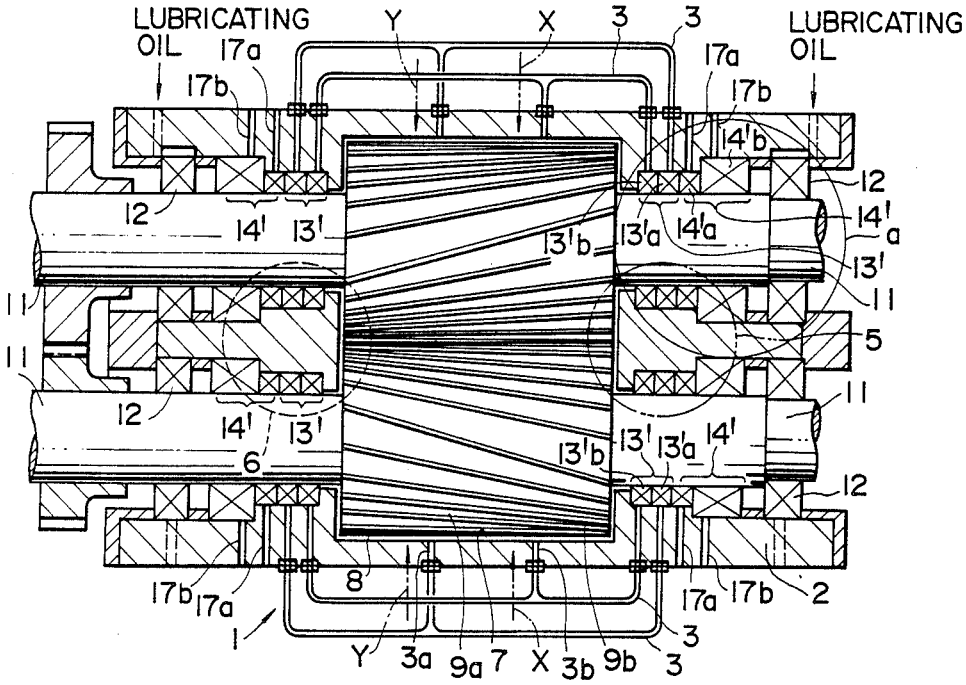
FIG. 7 is a transverse sectional view of the vacuum pump of a fourth preferred embodiment according to the present invention.
Figure 8:
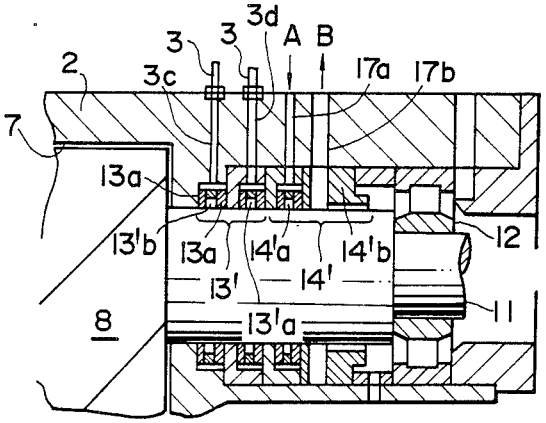
FIG. 8 is an enlarged view of an encircled part a shown in FIG. 7.

Referring to FIGS. 7 and 8 which shows a fourth embodiment, the rotor shafts 11 of each screw rotor 8 are supported by forcibly lubricated bearings 12. There are provided between the bearings 12 and the rotor chamber 7 on both the suction and discharge openings 5 and 6 sides first sealing means 13' consisting of two stages and second sealing means 14' as arranged in this order from the rotor chamber 7. The first sealing means 13' consists of two elements 13'*a* and 13'*b*, each element including two seal rings 13*a* juxtaposed. Similarly, the second sealing means 14' consists of two elements 14'*a* and 14'*b*. The element 14'*a* as arranged on the rotor chamber side includes two seal rings 13*a* juxtaposed, and the element 14'*b* on the bearing 12 side employs a labyrinth seal formed with a thread adapted to advance toward the bearing 12 in association with the rotation of the screw rotor 8.

The element 13'*a* of the first sealing means 13' under a higher pressure is communicated through a through-hole 3*a* and a communication pipe 3 to a tooth space portion 9*a* which is in a confined condition under much higher pressure, while the element 13'*b* under lower pressure is communicated through a through-hole 3*b* and another communication pipe 3 to a tooth space portion 9*b* which is in a confined condition under much lower pressure.

On the other hand, the elements 14'*a* and 14'*b* of the second sealing means 14' are communicated with atmosphere through a first atmospheric communication passage 17*a* and a second atmospheric communication passage 17*b*, respectively.

With this arrangement, the shaft seal portion of the second sealing means 14' is maintained under atmospheric pressure in communication with the first and second atmospheric communication passages 17*a* and 17*b*, and the shaft seal portion of the element 13'*b* of the first sealing means 13' on the rotor chamber 7 side is maintained under vacuum. Accordingly, the shaft seal portions of the two stages of the first sealing means 13' generate a pressure gradient which decreases from the bearing 12 side to the rotor chamber 7 side. The higher pressure portion of the first sealing means 13' having a plurality of stages is gradually sucked to the tooth space portion 9*b* defining a confined space under a much higher pressure, while the lower pressure portion of the first sealing means 13' is gradually sucked to the tooth space portion 9*a* defining a confined space under a much lower pressure. Therefore, the air tending to leak from the first atmospheric communication passage 17*a* under the atmospheric pressure to the rotor chamber 7 under vacuum may be effectively blocked by the first sealing means 13'.

The labyrinth portion of the second sealing means 14' on the bearing 12 side operates to force the lubricating oil to the bearing 12 in association with the rotation of the screw rotor 8 and prevent the oil from flowing into the rotor chamber 7. However, there is a possibility that the lubricating oil cannot be sufficiently expelled only by the labyrinth portion of the second sealing means 14' during rotation other than high speed rotation of the screw rotor 8. According to the present invention, there are provided the first and second atmospheric communication passages 17*a* and 17*b* communicating both elements of the second sealing means 14' to atmosphere, so that the lubricating oil may be reliably prevented from flowing into the rotor chamber 7 even during rotation other than high speed rotation of the screw rotor 8. In other words, the second sealing means 14' on the bearing 12 side is maintained under a higher pressure substantially equal to the atmospheric pressure, thereby hindering the lubricating oil from flowing through a gap between the second sealing means 14' and the rotor shaft 11 to the rotor chamber 7. Simultaneously, even if the lubricating oil flows through the gap to the rotor chamber, the oil may be expelled from the second atmospheric communication passage 17*b* to the exterior of the casing by the air flow from the first atmosphere communication passage 17*a* to the second atmosphere communication passage 17*b*, thereby completely preventing the oil from advancing to the rotor chamber 7.

In the event that the lubricating oil should leak from the second sealing means 14', such is discharged through the comunication pipe 3 to the gas confined space isolated from the suction opening 5 owing to the provision of the first sealing means 13'. Thus, the lubricating oil is completely prevented from leaking to the suction opening 5. As a result, it is possible to obtain a cleaner vacuum and further improve the attainable vacuum.

In the same manner as in the previous embodiments, there is a tendency that the lubricating oil and the air advance to the rotor chamber 7 and leak thereinto at the first and second sealing means 13' and 14' on the discharge opening 6 side as well as the suction opening 5 side. To cope with this problem, a communication pipe 3 communicating with the gas confined space is provided on the discharge opening 6 side as well as the suction opening 5 side, thereby completely preventing the lubricating oil and the air from leaking to the rotor chamber 7.

Figure 9:
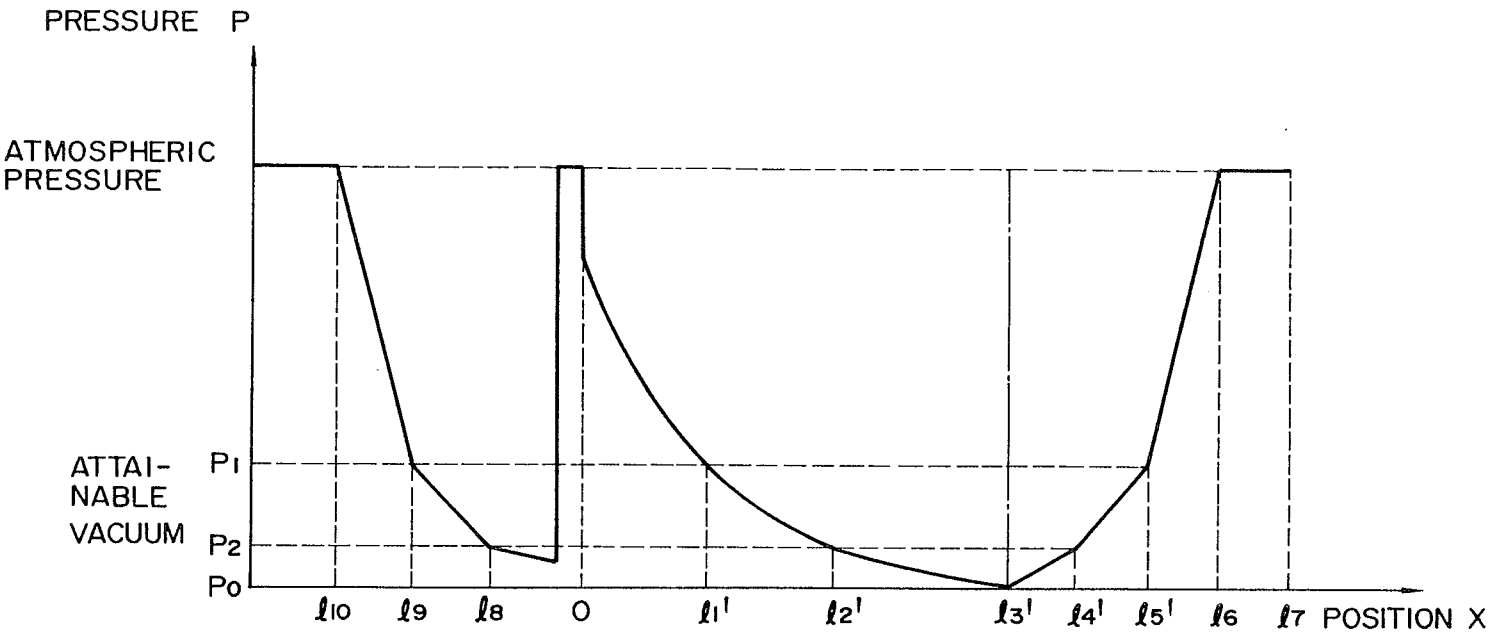
FIG. 9 is a graph showing a change in pressure in the vacuum pump shown in FIG. 7.

FIG. 9 shows a change in pressure at various positions along the axial direction of the rotor shaft 11 from the bearing 12 on the suction side through the suction opening 5 and the interior of the rotor chamber 7 to the discharge opening 6. Referring to FIG. 9, the abscissa shows the positions x along the axial direction of the rotor shaft (a rightward direction is regarded as positive) with the origin corresponding to the end surface of the discharge opening 6 of the rotor chamber 7, and the ordinate shows a degree of vacuum or pressure, where $l_1'$ and $l_2'$ denote positions of the through-holes 3*a* and 3*b* on high and low pressure sides of the communication pipe 3; $l_3'$ denotes a position of the end surface of the rotor chamber 7 on the suction opening 5 side; $l_4'$ and $l_5'$ denote positions of the through-holes 3*c* and 3*d* of the communication pipe 3 communicated with the first sealing means 13' and the through-holes 3*b* and 3*a*, respectively; $l_6$ and $l_7$ denote the positions of the first and second atmospheric communication passages 17*a* and 17*b*; $l_8$ and $l_9$ denote the positions of the through-holes on the discharge opening 6 side as corresponding to $l_4'$ and $l_5'$; and $l_{10}$ denotes the position of the first atmospheric communication passage 17*a* on the discharge opening 6 side. $P_1$ and $P_2$ denote the pressures at the tooth space portions corresponding to the positions $l_1'$ and $l_2'$. The pressure $P_1$ and $P_2$ are equal to the pressures at the positions $l_5'$ and $l_4'$ and at the positions $l_9$ and $l_8$ on the first sealing means 13' side.

As is apparent from FIG. 9, the degree of vacuum is stepwise increased from the position $x=l_6$ of the first atmospheric communication passage 17*a* under the atmospheric pressure to the positions $x=l_5'$, $l_4'$, and a pressure differential between $l_3'$ and $l_4'$ is relatively small. The quantity of air leaking to the rotor chamber causing the reduction in attainable vacuum is substantially proportional to the above-mentioned pressure differential. Therefore, the attainable vacuum may be improved by effectively reducing the pressure differential. The pressure change along the axial direction of the rotor shaft from the bearing 12 to the first and second sealing means 13' and 14' on the discharge opening 6 side is similar to the above, and such is designed to reduce that described air leaking through a gap at the end surface of the rotor chamber 7 on the discharge opening 6 side to the suction opening 5.

Although the communication pipe 3 communicating the suction opening 5 side to the confined space is joined with the communication pipe 3 communicating the discharge opening 6 side to the confined space in the above embodiment, the present invention is not limited to this construction. For instance, as shown in FIG. 7, the inner element of the first sealing means 13' on the discharge opening 6 side is communicated with a position as depicted by an arrow X, and the outer element is communicated with a position as depicted by an arrow Y as independent of the suction opening 5 side.

Figure 10:
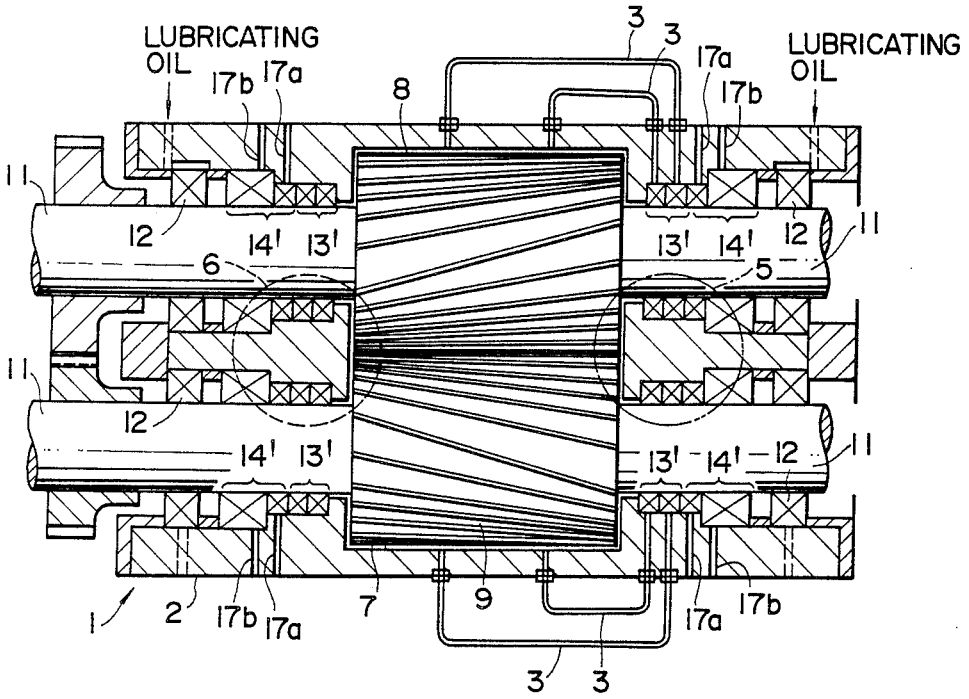
FIG. 10 is a transverse sectional view of the vacuum pump of a fifth preferred embodiment according to the present invention.
Figure 11:
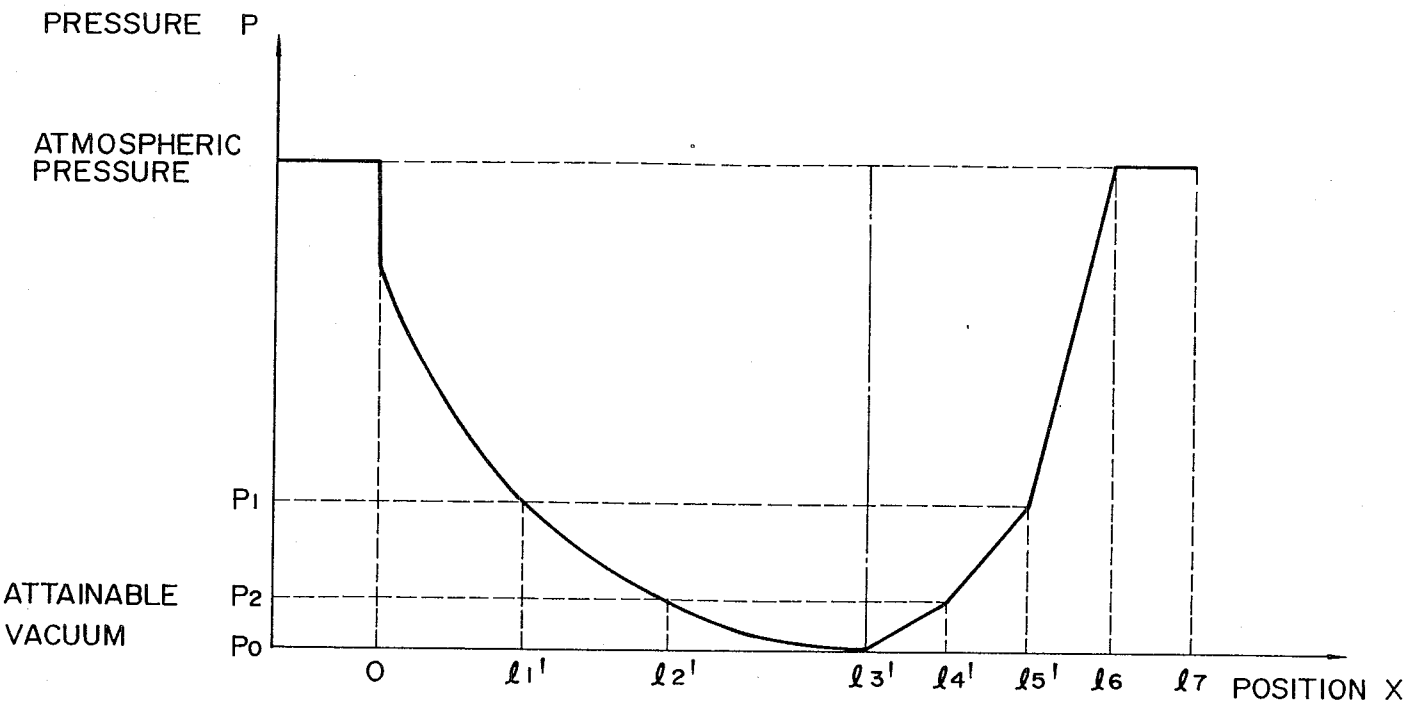
FIG. 11 is a graph showing a change in pressure in the vacuum pump shown in FIG. 10.
Figure 1:
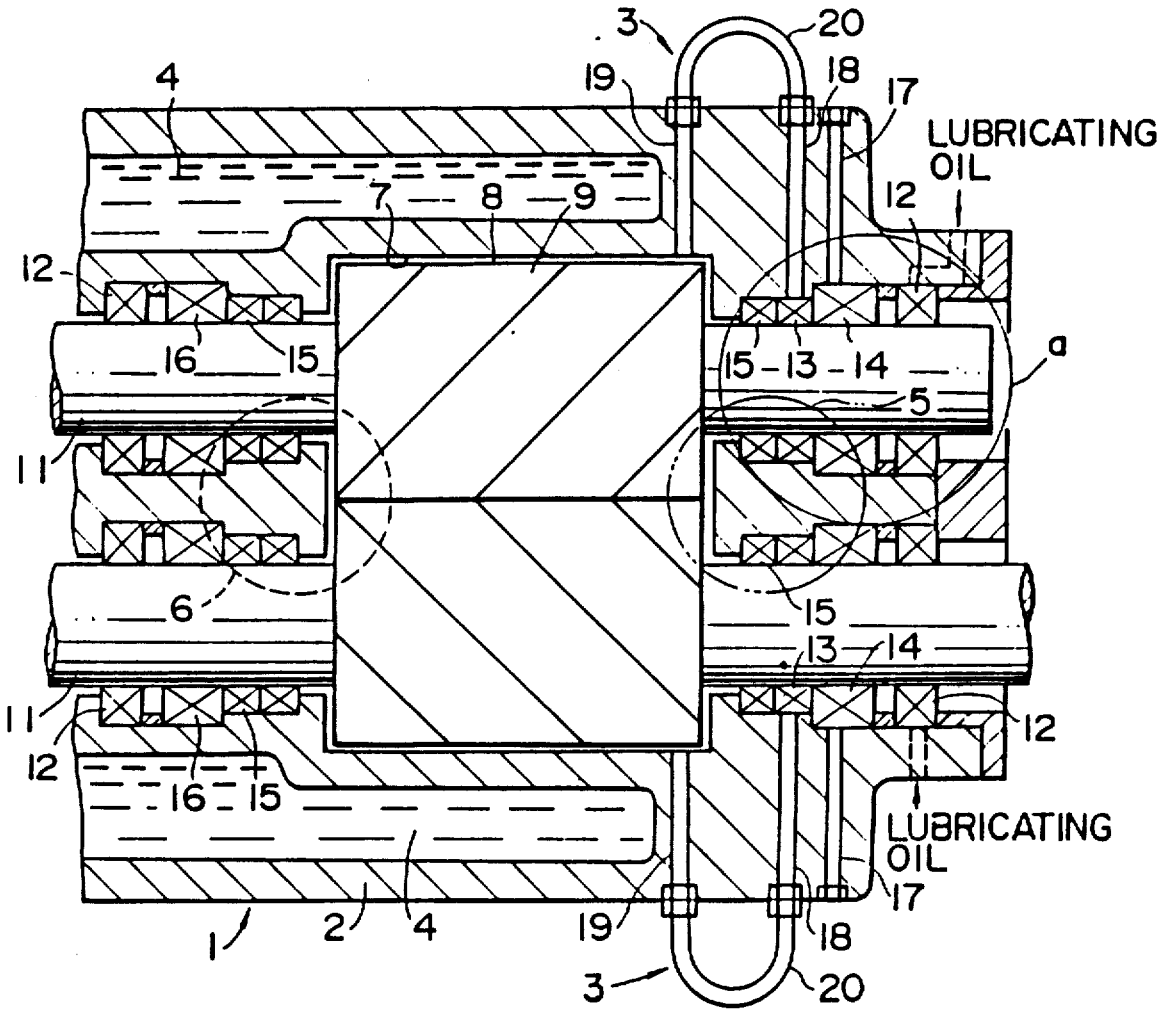
Figure 4:
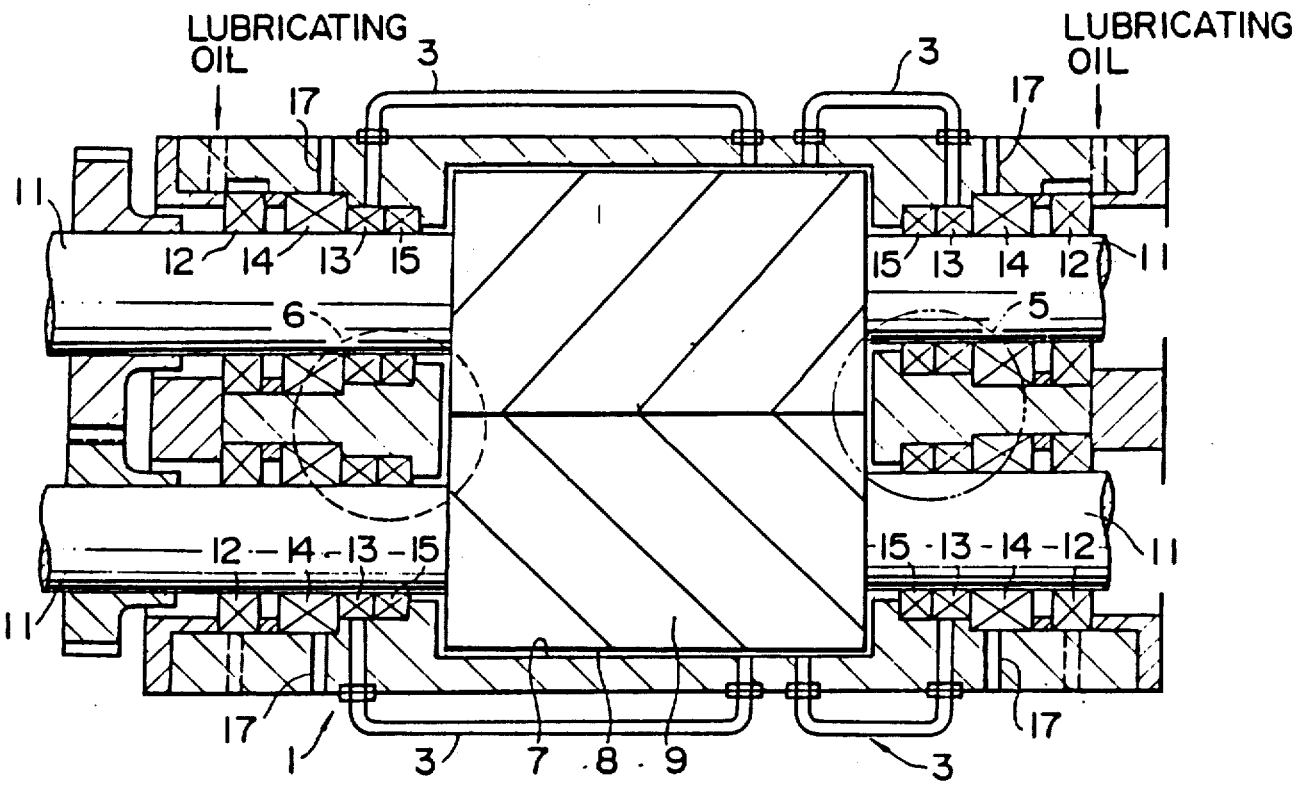
Figure 6:
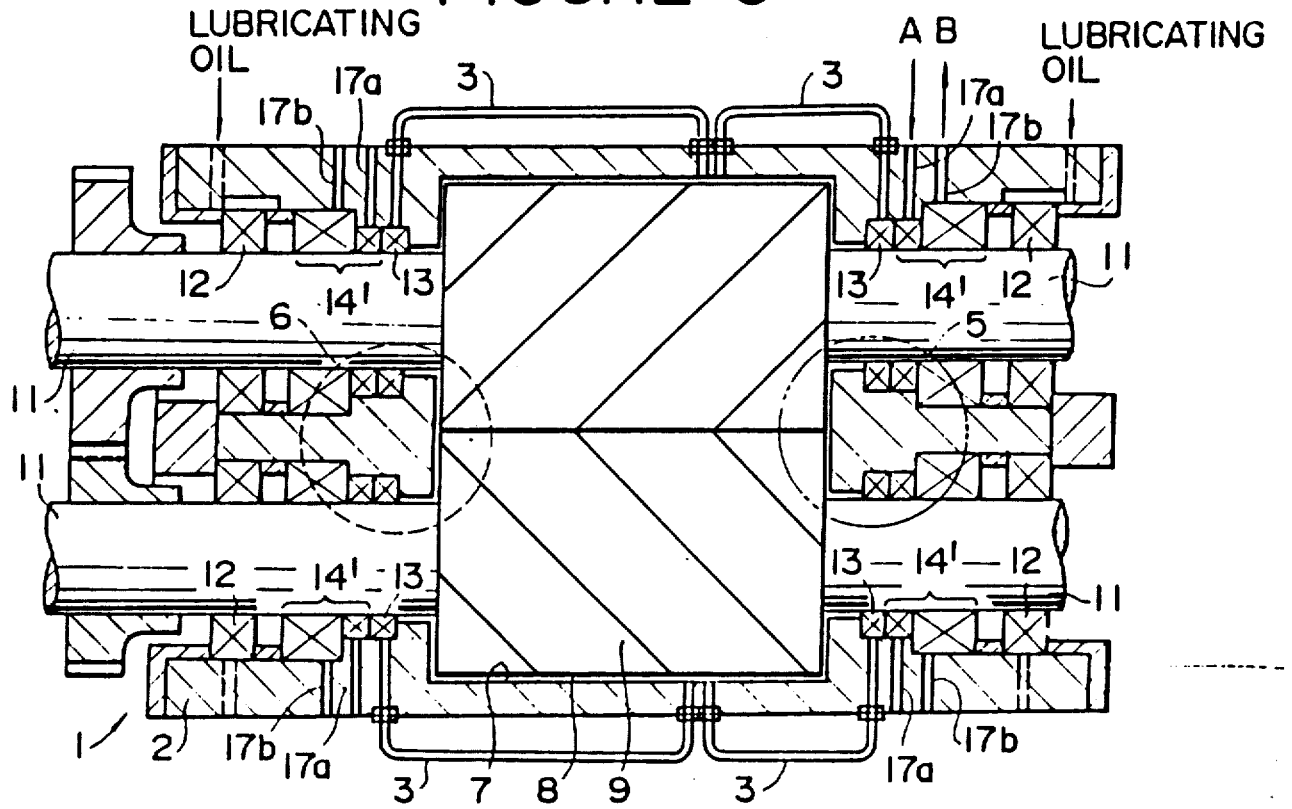
Figure 7:
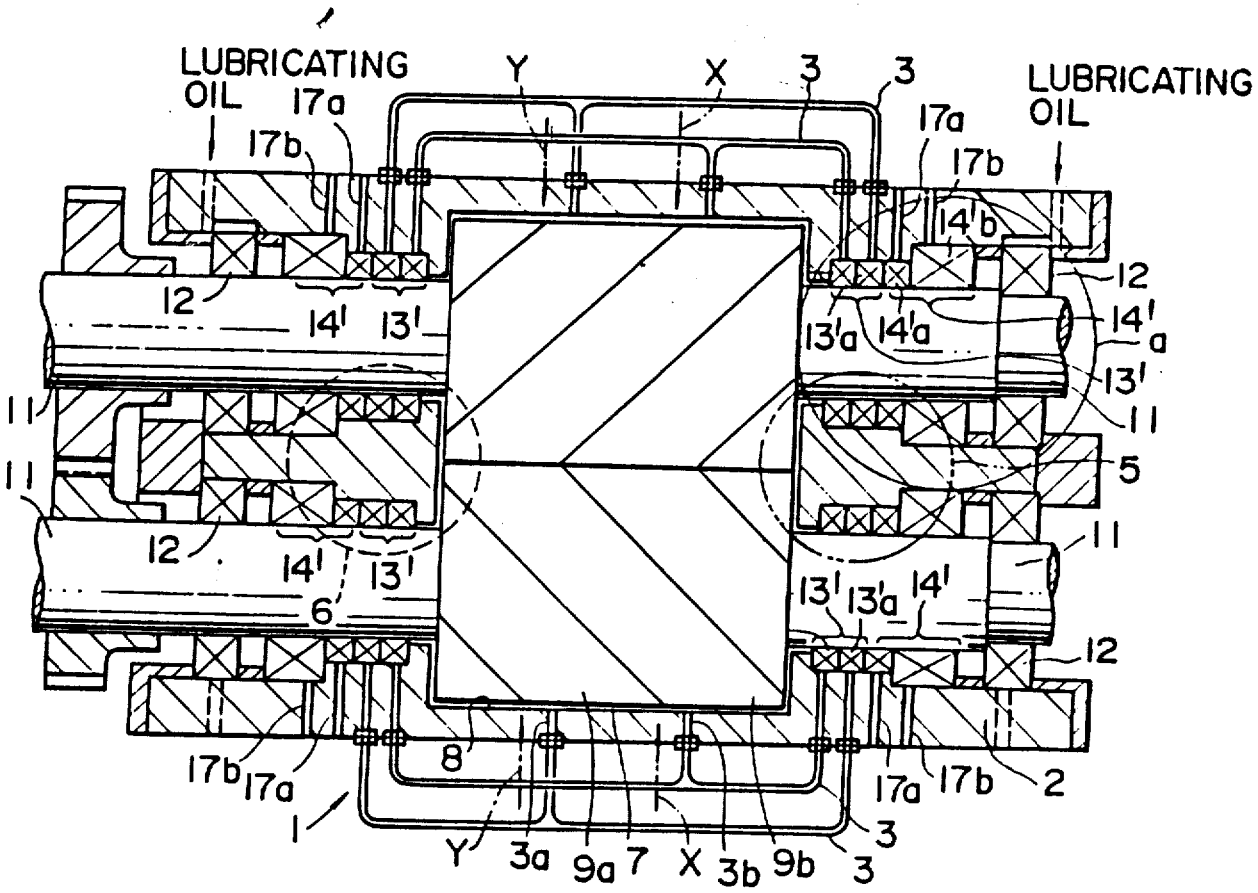
Figure 10:
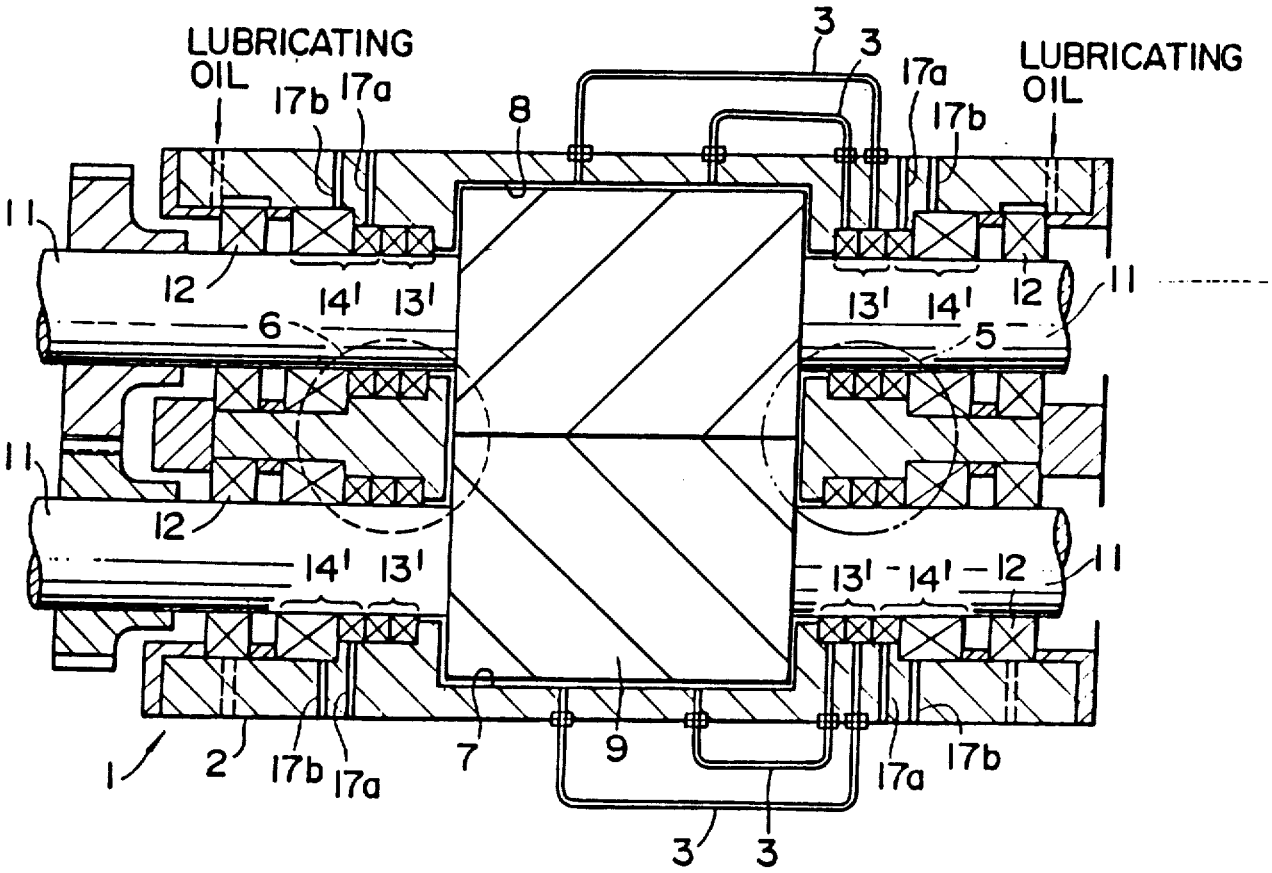

Referring to FIG. 10 which shows a fifth preferred embodiment, the first sealing means 13' is provided on the suction opening 5 side only. The corresponding parts as in FIGS. 7 to 9 are designated by the same reference numerals. FIG. 11 shows a pressure condition of the vacuum pump shown in FIG. 10.

Although the element of the first sealing means 13' near the bearing 12 is communicated with the tooth space portion having a higher pressure in the above embodiment, the present invention is not limited to this construction. For example, each element of the first sealing means may be communicated to the same tooth space portion under the confined condition.

Further, although the first and second sealing means 13' and 14' are arranged symmetrically on both sides of the male and female rotors in the above embodiment, the communication pipe 3 may be provided for either of the male or female rotor. Additionally, a water cooling jacket may be provided outside the casing 2 so as to cool the interior of the rotor chamber 7.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A screw vacuum pump comprising:

a casing having a rotor chamber opened at a first axial end thereof to a suction opening and opened at a second end thereof to a discharge opening;

a pair of male and female screw rotors rotatably received in said rotor chamber, each of said screw rotors having a pair of rotor shafts supported by forcibly lubricated bearings on both sides of said suction opening and said discharge opening;

at least one first sealing means provided between said bearing on at least said suction opening side and said rotor chamber and communicated with a space under a pressure less than atmospheric pressure, which space is out of communication with said suction opening such that a pressure differential between the suction opening and said first sealing means is reduced to thereby prevent air leakage from the first sealing means to said suction opening and for preventing lubricating oil from flowing into said suction opening; and at least one second sealing means provided between said bearing on at least said suction opening side and said rotor chamber and communicated with atmosphere, said first and second sealing means being arranged in this order from said rotor chamber side.

2. The screw vacuum pump as defined in claim 1, wherein said first sealing means comprises a plurality of seal rings, and one seal ring adjacent said bearing is communicated with a tooth space portion defining a gas confined space having a higher pressure in said rotor chamber than an unconfined space at said suction opening.

* * * * *

UNITED STATES PATENT AND TRADEMARK OFFICE

CERTIFICATE OF CORRECTION

PATENT NO. : 4,781,553

DATED : November 1, 1988

INVENTOR(S) : Ituro Nomura et al

It is certified that error appears in the above-identified patent and that said Letters Patent is hereby corrected as shown below:

Figures 1,4,6,7 and 10 of the drawings should be deleted to be replaced with figures 1,4,6,7 and 10 as shown on the attached sheets.

Signed and Sealed this

Eighteenth Day of July, 1989

*Attest:*

DONALD J. QUIGG

*Attesting Officer*

*Commissioner of Patents and Trademarks*